US007280086B2

(12) United States Patent
Judasz et al.

(10) Patent No.: US 7,280,086 B2
(45) Date of Patent: Oct. 9, 2007

(54) REFLECTING ANTENNA WITH 3D STRUCTURE FOR SHAPING WAVE BEAMS BELONGING TO DIFFERENT FREQUENCY BANDS

(75) Inventors: Thierry Judasz, Ramonville (FR); Jean-François David, Toulouse (FR); Jacques Maurel, Cugnaux (FR)

(73) Assignee: Thales, Neuilly sur Seine (FR)

( * ) Notice: Subject to any disclaimer, the term of this patent is extended or adjusted under 35 U.S.C. 154(b) by 4 days.

(21) Appl. No.: 11/095,526

(22) Filed: Apr. 1, 2005

(65) Prior Publication Data

US 2005/0219146 A1 Oct. 6, 2005

(30) Foreign Application Priority Data

Apr. 2, 2004 (FR) ..... 04 50662

(51) Int. Cl.
*H01Q 15/14* (2006.01)

(52) U.S. Cl. ..... 343/912; 343/909

(58) Field of Classification Search ..... 343/912, 343/840, 757, 914, 781 P, 781 R, 909
See application file for complete search history.

(56) References Cited

U.S. PATENT DOCUMENTS 5,585,807 A * 12/1996 Takei ..... 343/702
7,065,379 B1 * 6/2006 Kim et al. ..... 455/575.5
2004/0036661 A1 2/2004 Chang et al. ..... 343/786

FOREIGN PATENT DOCUMENTS

EP 1 020 953 A 7/2000
EP 1 083 625 A 3/2001

OTHER PUBLICATIONS

Wu T K et al: "Multi-ring element FSS for multi-band applications." Proceedings of the Antennas and Propagation Society International Symposium (APSIS). Chicago, Jul. 20-24, 1992, New York, IEEE, US, vol. vol. 2, Jul. 18, 1992, pp. 1775-1778, XP010066047.
Ueno K et al: Characteristics of frequency selective surfaces for a multi-band communication satellite Proceedings of the Antennas and Propagation Society Annual Meeting. 1991. Venue and Exact Date not Shown, New York, IEEE, US, vol. vol. 2, Jun. 24, 1991, pp. 735-738, XP010050653.

* cited by examiner

*Primary Examiner*—Hoang V. Nguyen
*Assistant Examiner*—Ephrem Alemu
(74) *Attorney, Agent, or Firm*—Sughrue Mion, PLLC

(57) ABSTRACT

Multifrequency reflecting antenna (AR), for example for a telecommunication satellite that comprises a reflector (R) with a front face (FA) for reflecting beams of electromagnetic waves belonging to at least two different frequency bands. The front face (FA) of the reflector (R) comprises a structure (ST) defining a three-dimensional pattern with symmetry of revolution, chosen so as to shape the beams such that they have approximately identical radiofrequency characteristics.

20 Claims, 4 Drawing Sheets

Figure 1:
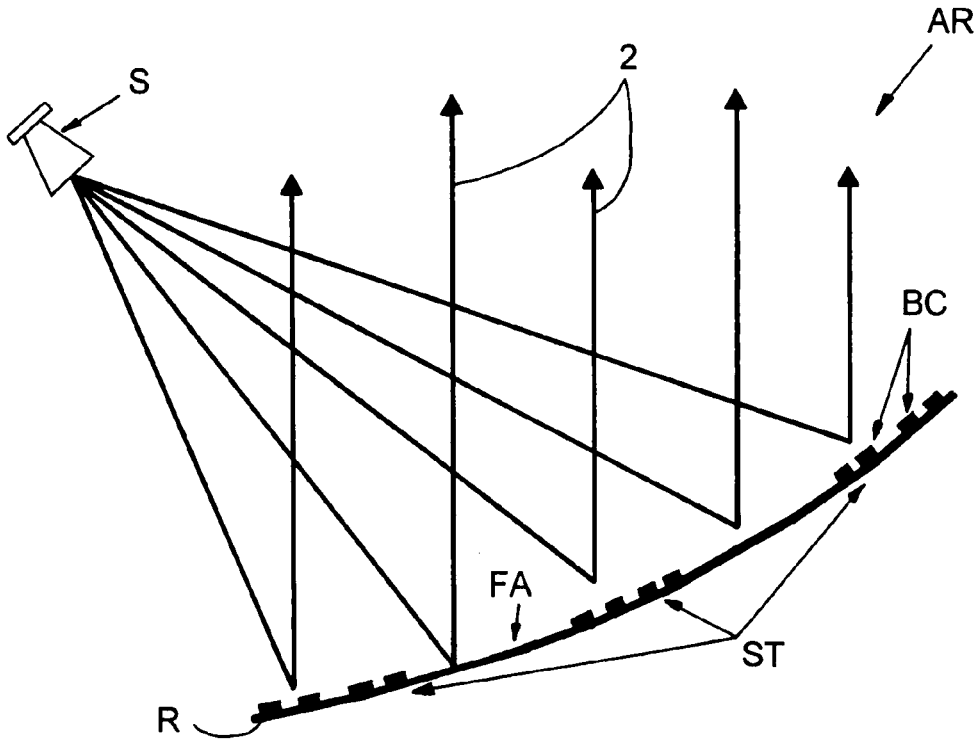

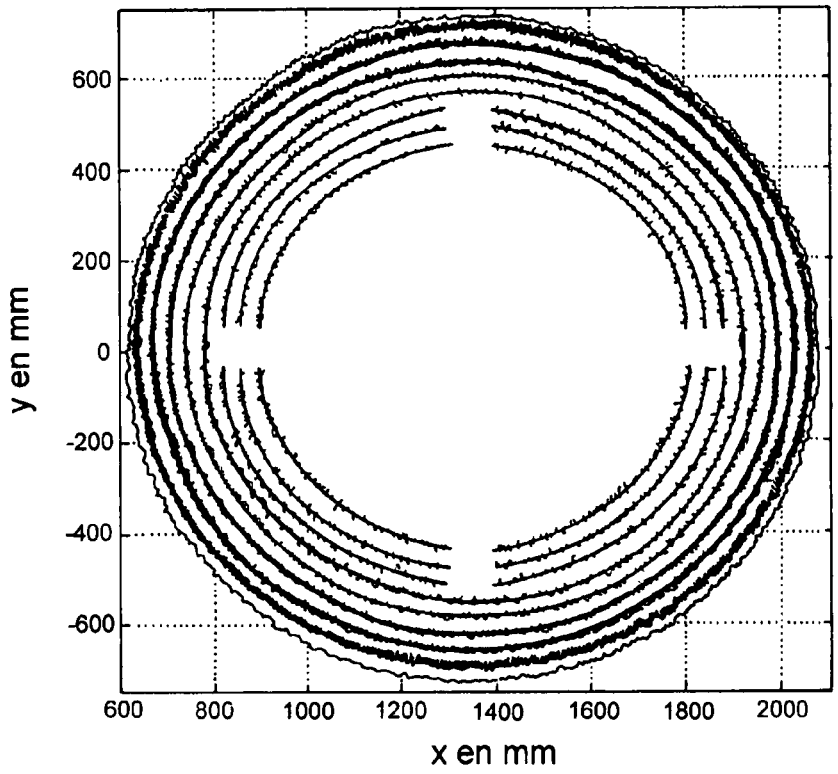
FIG.3
FIG.4
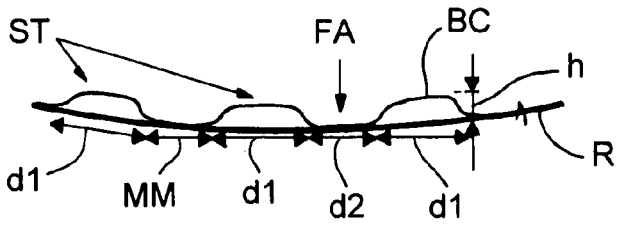
FIG.5
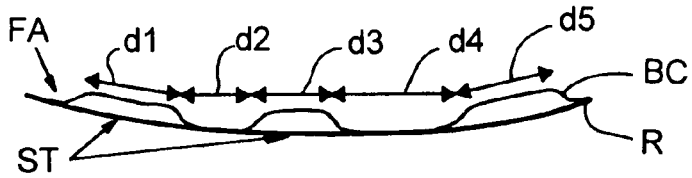
FIG.6
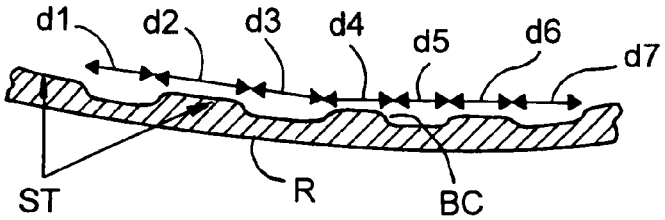

REFLECTING ANTENNA WITH 3D STRUCTURE FOR SHAPING WAVE BEAMS BELONGING TO DIFFERENT FREQUENCY BANDS

This application claims priority from French Application No. 0450662, filed on Apr. 2, 2004.

The invention relates to the domain of hyperfrequency (or RF) reflecting antennas and more particularly reflecting antennas intended for transmission and/or reception of electromagnetic waves belonging to at least two frequency bands.

For the purposes of this description, a frequency band is a band that comprises at least one frequency.

A reflecting antenna of this type comprises particularly a reflector designed to reflect electromagnetic waves that it receives either from a local source intended for a remote collector, or from a remote source when they are intended for a local collector. Note that an antenna may comprise either one or several local sources, or one or several local collectors, or one of several local sources and one or several local collectors, possibly combined.

Some applications, for example such as space applications, impose specific constraints on onboard antennas. For example, some telecommunication satellites are designed to transmit and receive several beams (or "narrow beams"). To achieve this objective, it was initially proposed to put several single frequency and/or single beam antennas in parallel, each being dedicated to transmission or reception. This simple solution is inefficient. A hundred antennas would be necessary to work with 50 transmission beams and 50 reception beams, with one beam per antenna.

In theory, it is possible to group all transmission beams on one transmission antenna and all reception beams on one reception antenna. But this solution is impossible in practice because it is impossible to house all sources (transmission and reception) side by side on antennas with a size and weight compatible with space applications.

One intermediate solution is referred to by those skilled in the art as a "colored mosaic of sources". This solution consists for example of distributing sources that should initially be adjacent onto three or four transmission antennas and three or four reception antennas, so as to release space for each source. Each antenna is then dedicated to a single color or frequency. However, the number of antennas still remains high (for example 6 or 8).

Moreover in some applications, for example multimedia applications in Ka-band that require multibeam and/or multifrequency antennas with high directivity at several different frequencies, there is often a need for a large number (for example 50) of relatively narrow beams therefore high gain beams, for each of the frequencies and therefore specific sources and/or collectors. Yet the design of such sources and such collectors is particularly difficult or even impossible, considering the constraints that arise.

Remember that the size of the reflector defines the size and the gain of the beam. In one good approximation, the width ($\theta$) of a beam at −3 dB is equal to 65 times the wavelength $\lambda$ (in millimeters) or waves to be transmitted divided by the diameter D (in millimeters) of the antenna, namely $\theta=65\lambda/D$. Consequently, in the presence of a single antenna and waves with two significantly different frequencies, for example 20 and 30 GHz, the width of the 30 GHz beam is narrower than the width of the 20 GHz beam because the frequency f (in GHz) and the wavelength $\lambda$ (in mm) are related by the relation $\lambda=300/f$. The areas that receive the two transmitted beams, or from which the beams originate, are then (very) different. Similarly, the area from which one of the two beams originates does not correspond to the area that receives the other beam. This is a real disadvantage.

An antenna has been proposed, particularly in patent document EP 1 083 625, in an attempt to overcome this disadvantage, comprising a reflector for which the front face is subdivided into a first "central" part that reflects wave beams at first and second frequencies, and a second "peripheral" part surrounding the first part and intended to selectively reflect only the lower of the two frequencies, while diffracting or shifting the phase of the higher frequency as destructively as possible. The radial extensions of the two parts are chosen so that the electrical dimensions of the reflector (in terms of the number of wavelengths) are approximately the same for the two frequencies, and consequently the widths of the two reflected beams are approximately equal. For example, in the case of the 20 and 30 GHz beams, if R is the radius of the antenna and if the entire antenna (reflector) is used at 20 GHz, in other words R, then at 30 GHz only 2R/3 is used to obtain the same size beams at the two frequencies.

In order to prevent waves with the highest frequency from being reflected from the second part of the antenna, this part comprises a network of concentric projecting or recessed strips, with identical dimensions and constant pitch. In a first embodiment, each strip has a rectangular cross-section so as to introduce a destructive phase shift of 180° between waves reflected on the vertex of the strips and the waves reflected in inter-strip space. In a second embodiment, each strip has a sawtooth shaped cross-section so as to diffract waves with the highest frequency in all directions.

It is essential that the rectangular profile of the network should be rigorously respected, so that the first embodiment can produce the required result (deletion by destructive phase shift). Similarly, it is essential that the tapered sawtooth profile (right angle triangle) of the network should be rigorously respected, so that the second embodiment can produce the required result (diffraction in all directions).

This type of sudden profiles can be obtained in metallic materials (typically with a density of more than 2.7) such as aluminum or steel or an alloy. But it is significantly more difficult to obtain them using materials frequently used in space applications, for example such as carbon fiber/organic resin or other composite materials (for example such as CFRP (Carbon Fiber Reinforced Plastics)). Consequently, the solution proposed in the above-mentioned patent document can probably be used for a land application, but not for a space application in which mass is of overriding importance for the rest of a mission.

Furthermore, the technique used to assure that the electrical dimension of the reflector is approximately the same for the two frequencies, increases the size of the main lobe of the antenna diagram for the highest frequencies, without any specific and/or precise action on secondary (or lateral lobes), such that the level of these lobes is high, while the quality of the main beam associated with the main lobe is low, and the combined isolation parameter (C/I) between beams with the same frequency is low.

Furthermore, this technique causing deletion or diffraction of a part of the signal, significantly reduces the energy efficiency of the antenna.

Finally, this technique does not take account of the transmission diagram of the source(s) that usually include(s) imperfections that consequently remain uncorrected, or improvements not taken into account.

No known reflector antenna is fully satisfactory, and therefore the purpose of the invention is to improve this situation.

It proposes a multifrequency reflecting antenna comprising a reflector provided with a front face for reflecting beams of electromagnetic waves belonging to at least two different frequency bands.

This antenna is characterized by the fact that the front face of its reflector preferably includes a structure with a three-dimensional pattern (3D) with symmetry of revolution (or rotation) over its entire surface, chosen so as to shape beams such that they have approximately the same radiofrequency (RF) characteristics.

Thus, unlike prior art in which a part of the signal is deleted either by destructive phase shift or by diffraction, in this case the beams are shaped so as to have approximately the same radiofrequency characteristics.

The three-dimensional pattern may be composed of projecting or recessed concentric strips comprising leading edges with a radius of gyration (or curvature) between about 1 mm and about 200 mm and preferably between about 10 mm and about 40 mm.

Furthermore, each concentric strip may extend over a fixed or variable chosen width and over a fixed or variable chosen height, and the different concentric strips may separated from each other by a constant or variable pitch.

When the antenna is dedicated to transmission and reception, it comprises at least one source outputting a first beam of electromagnetic waves to be transmitted belonging to a first frequency band, and at least one collector possibly coincident with the source, for collecting a second beam belonging to a second frequency band. In this case, the reflector is arranged so as to transmit the first beam output from the source after reflection and shaping by its front face, and to receive a beam of electromagnetic waves belonging to the second frequency band to transmit it to the collector in the form of the second beam after reflection and shaping by its front face.

When the antenna is dedicated to transmission alone, it comprises at least one source of beams to be transmitted. In this case, the reflector is arranged so as to transmit beams of electromagnetic waves belonging to at least two different frequency bands and originating from the source after reflection and shaping by its front face.

In the two above antenna embodiments, it is advantageous if the three dimensional pattern is chosen as a function of the source transmission diagram.

When the antenna is dedicated to reception alone, it comprises at least one beam collector. In this case, the reflector is arranged so as to receive electromagnetic wave beams belonging to at least two frequency bands to transmit them to the collector after reflection and shaping by its front face.

Finally, the structure may be added onto the front face, or it may form an integral part of the front face.

The invention is particularly well although not exclusively adapted to the field of space telecommunications, particularly the Ka-band (17.7 to 31 GHz).

Figure 2:
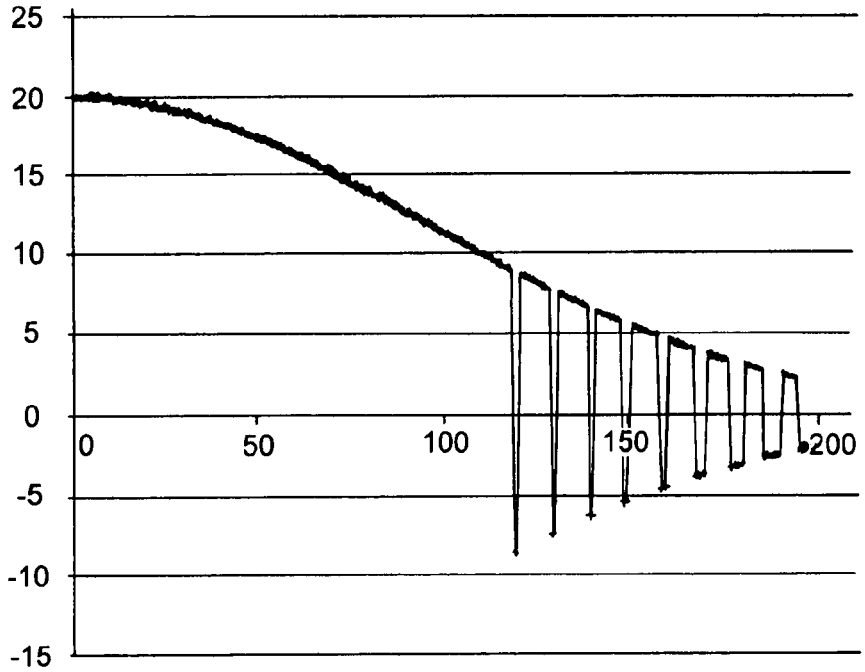
Figure 7:
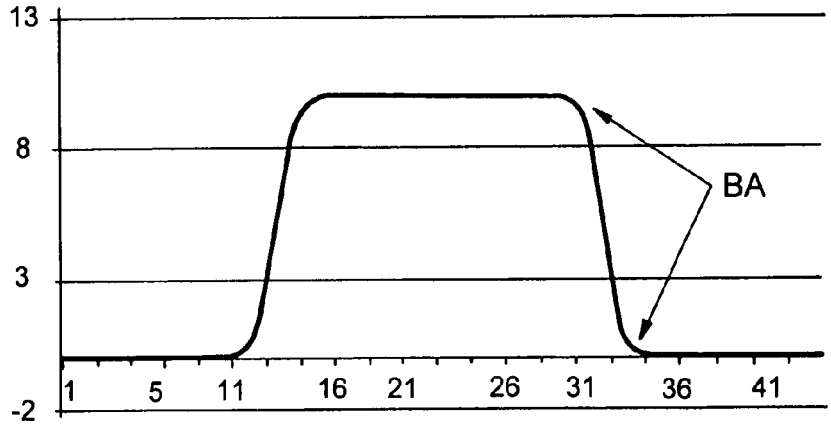
Figure 8:
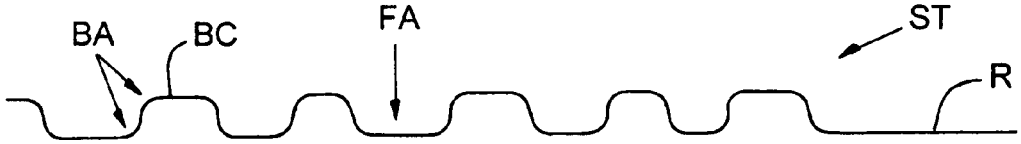
Figure 9:
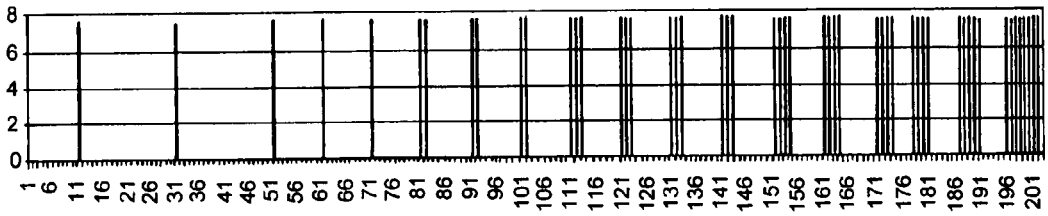
Figure 10:
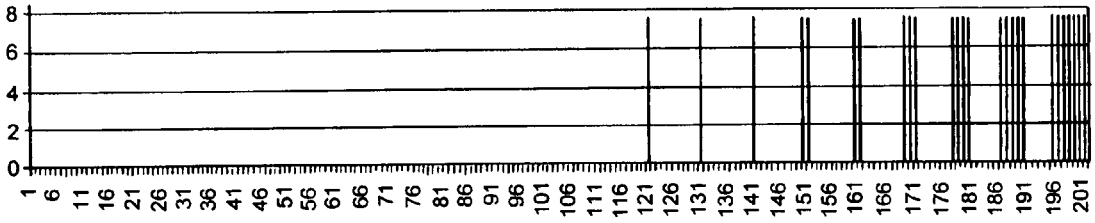
Figure 11:
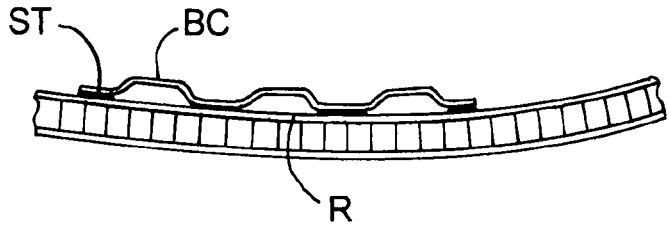
Figure 12:
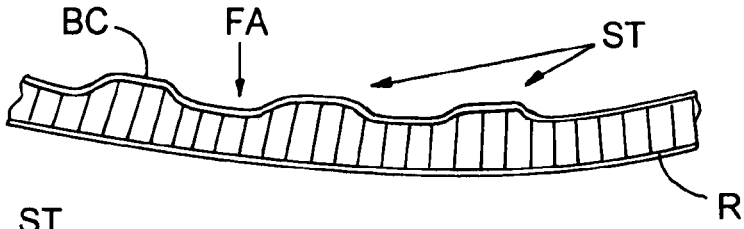
Figure 13:
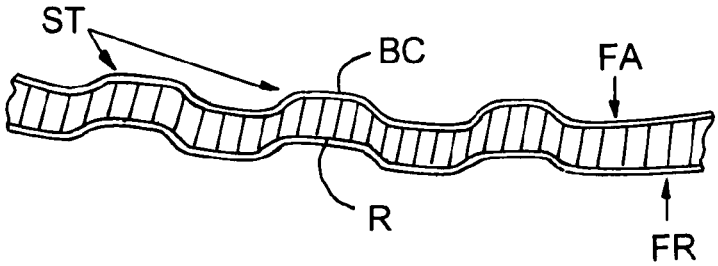
Figure 14:
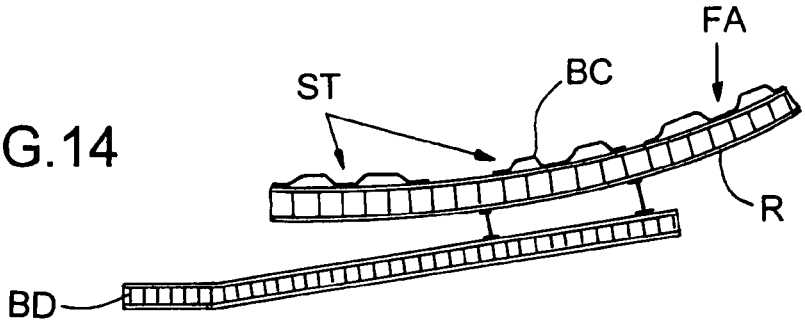
Figure 15:
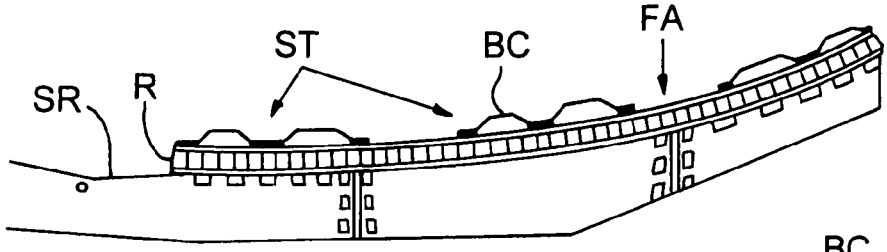
Figure 16:
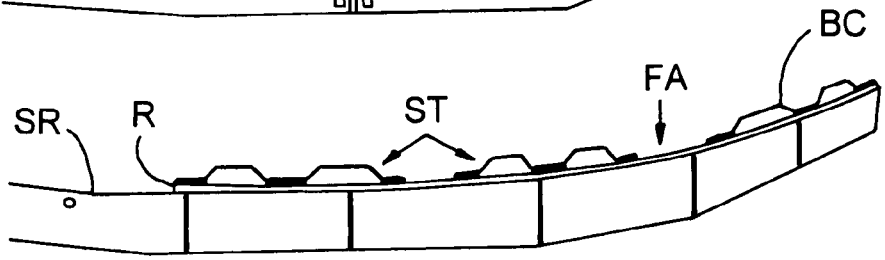

Other characteristics and advantages of the invention will become clear after reading the following detailed description and the appended drawings in which:

FIG. 1 shows a cross-sectional view diagrammatically illustrating an example embodiment of a multifrequency reflecting antenna according to the invention, dedicated to transmission, FIG. 2 illustrates an example distribution of total current ($C_T$ in arbitrary units) as a function of the radius of the reflector (in arbitrary units), FIG. 3 illustrates an example offset surface or pattern from a reference parabola, FIG. 4 is a cross-sectional view very diagrammatically illustrating a first example embodiment of a projecting beam shaping structure of the symmetric type, FIG. 5 is a cross-sectional view very diagrammatically illustrating a second example embodiment of a projecting beam shaping structure, with irregular spacing of concentric strips, FIG. 6 is a cross-sectional view very diagrammatically illustrating a third example embodiment of a recessed beam shaping structure, with irregular spacing of concentric strips, FIG. 7 is a cross-sectional view very diagrammatically illustrating a concentric strip of a beam shaping structure, FIG. 8 is a cross-sectional view very diagrammatically illustrating a fourth example embodiment of part of a projecting beam shaping structure with irregular spacing of concentric strips of the type illustrated in FIG. 7, FIG. 9 is a top view very diagrammatically illustrating a first example embodiment of a plane projection of a part of a beam shaping structure with irregular spacing of the concentric strips, FIG. 10 is a top view very diagrammatically illustrating a second example embodiment of a plane projection of a part of a beam shaping structure, with irregular spacing of the concentric strips, FIG. 11 is a cross-sectional view very diagrammatically illustrating a first example embodiment of a part of a reflector equipped with an added on beam shaping structure, FIG. 12 is a cross-sectional view very diagrammatically illustrating a second example embodiment of a part of a reflector comprising a beam shaping structure made by recessed molding of its front face, FIG. 13 is a cross-sectional view very diagrammatically illustrating a third example embodiment of a part of a reflector comprising a beam shaping structure made by recessed molding of its front face and projecting molding of its back face, FIG. 14 is a cross-sectional view very diagrammatically illustrating a cellular reflector using the so-called sandwich type "thick shell" technology similar to that in FIG. 11, installed on an extension arm itself connected to a satellite platform, FIG. 15 is a cross-sectional view very diagrammatically illustrating a so-called sandwich type "stiffened thin shell" technology installed on a rigid satellite support structure, and FIG. 16 is a cross-sectional view very diagrammatically illustrating an ultra thin shell reflector installed on a rigid support structure composed of assembled monolithic elements.

The appended drawings can be used not only to complete the invention, but also to contribute to its definition if applicable.

The purpose of the invention is for shaping of beams by a reflector of a multifrequency antenna, possibly and preferably of the multibeam type.

The invention relates to all types of onboard and land multifrequency reflecting antennas operating in the hyperfrequency field, particularly antennas for more than one gigahertz (GHz) and more particularly for antennas belonging to the Ka-band (17.7 GHz to 31 GHz).

In the following description, it is considered for illustrative purposes that the antennas are onboard telecommunication satellites and operate in the Ka-band.

Refer firstly to FIG. 1 to describe an example embodiment of a multifrequency reflecting antenna AR according to the invention. In this example, the reflecting antenna AR is for example dedicated exclusively to the transmission of electromagnetic waves according to two frequency bands centered on the values 20 GHz and 30 GHz. In the following, it is assumed that the first frequency band has a central value 20 GHz and the second frequency band has a central value 30 GHz, in order to simplify the description.

Obviously, the antenna could be dedicated exclusively to reception of electromagnetic wave beams in at least two frequency bands, or to the transmission of electromagnetic waves with at least one frequency and reception of electromagnetic waves with at least one other frequency. In general, the invention relates to applications with at least a two frequency bands.

The illustrated multifrequency reflecting antenna AR comprises a source S supplying a reflector R with electromagnetic waves with first (20 GHz) and second (30 GHz) frequencies. Any type of efficient source known to those skilled in the art could be used for this purpose.

Obviously, instead of a single source S producing the first and second frequencies according to the chosen transmission diagrams, it would be possible to have two sources, one producing the first and the other producing the second frequency according to a chosen transmission diagram. What is important here is not the number of sources used, but the difference in frequency between the first and second frequencies.

The reflector R comprises a rigid shell, in this case fixed to an extension arm or the structure of the space vessel (in this case a satellite). This rigid shell, which will be discussed in more detail later, comprises a front face FA designed to reflect electromagnetic waves output by the source S in accordance with its transmission diagrams in the form of first and second beams aimed at the same land area.

According to the invention, the front face FA of the reflector R comprises a structure ST that defines a three-dimensional pattern (3D) with symmetry of revolution (or rotation). This 3D pattern is chosen so as to shape the two beams such that they have approximately the same radiofrequency characteristics (RF).

In this description, "radiofrequency characteristics" refers to electromagnetic characteristics, for example such as the beam width that characterizes the directivity of the antenna and/or the electromagnetic radiation diagram, for example such as the energy distribution in a transverse plane (main lobe and secondary (or lateral) lobes), and possibly the attenuation (or roll off).

Due to this shaping of the beams by the structure ST of the reflector R, very thin beams (or narrow beams) can be obtained. For example, 20 and 30 GHz beams may have a width between about 0.5° and 1° (which applies to an antenna with very high directivity). In this case, the diameter of the reflecting antenna AR is between about 1500 mm and about 1600 mm, for example about 1560 mm.

Obviously, the invention is also applicable to wider or very much wider beams, and also to narrower beams.

The 3D pattern is calculated using a computer taking account of the geometric characteristics required for the two beams. The calculation may also take account of the transmission diagrams of the source S for the first frequency (in this case 20 GHz) and the second frequency (in this case 30 GHz). Advantageously this at least partially corrects imperfections in the transmission diagrams (and also reception diagrams when the antenna works in reception or transmission/reception) and improvements not taken into account.

The 3D pattern for shaping the two beams may be calculated in two steps: a first step that solves a two-directional (2D) antenna illumination problem, then a second step consisting of generalizing the problem to 3D illumination.

The 2D problem to be solved relates to determination of the electromagnetic field E derived from the aperture as a function of the angle θ representative of antenna sighting angles (usually between 0° and 180°), given by the following formula:

$$E(\theta) = \int_{aperture} I_d \cdot e^{(-*jkd\cdot\cos\theta)}\Big]$$

where $I_d$ is the current in the aperture, k is the number of waves ($k=2\pi/\lambda$), d is a distance in the aperture, and λ is the wavelength.

The following variable can be changed in order to facilitate the resolution:

$$\psi=\pi\cdot\cos(\theta)+\alpha.$$

An attempt is made to determine a current distribution used to obtain a far field diagram as close as possible to a "gate" type (or step) type function or a Chebychev type diagram with secondary (or lateral) lobes at a very low level (for example −30 dB).

Once the required far field has been chosen, an inverse Fourier transform is applied to it so as to obtain the corresponding current distribution. For example, when the far field diagram is a gate function, the current distribution is close to a sin x/x function.

The total current distribution can then be separated into two parts using the formula $C_T=C_S*C_R$, where $C_T$ is the total current distribution (in other words the inverse transform of the required far field), $C_S$ is the contribution of the source S in amplitude and in phase at the reflector R, and $C_R$ is the contribution of the reflector R to the amplitude and the phase of the total current (for example the phase change induced by a change in the shape of the reflector).

Note that the contribution $C_S$ of the source S depends on its transmission diagram (which can be adapted as a function of the aperture width of the source S). Since $C_S$ is known and $C_T$ has been determined, $C_R$ can be determined from the formula $C_R=C_T/C_S$.

Note that the contribution $C_R$ of the reflector applies to the amplitude and the phase, including signs.

For example, this function $C_R$ is in the shape of a truncated cosine with a maximum at the center of the reflector, then decaying, then passing through zero and then becoming negative.

This function can be approximated by combining reflector sections with height 0 mm (normal section) and sections with height equal 7.5 mm (raised section) or −7.5 mm (lowered section), for the two frequencies 20 and 30 GHz. The wavelengths are then 15 and 10 mm, and 7.5 mm represents λ/2 and 3λ/4 respectively for the two frequencies.

When the 20 GHz wave meets a λ/2 section, it is reflected and the phase is shifted by λ from the adjacent section, such that it is in phase with the adjacent wave.

When the 20 GHz wave meets a 3λ/4 section, it is reflected and the phase is shifted by 3λ/2 or 180° from the adjacent section, such that it is in phase with the adjacent wave.

Therefore, the integral of adjacent sections becomes more positive as sections become more "normal". It becomes more negative as the number of raised (or lowered) sections increases. Thus, the function $C_R$ can be approximated by putting normal (or positive) sections and raised (or negative, or lowered) sections adjacent to each other in the proportions necessary as a function of the amplitude and the local sign of $C_R$.

The accuracy or precision of the integral is proportional to the width of the sections.

One example total current distribution $C_T$ as a function of the reflector radius is given in FIG. 2.

A simple three-dimensional generalization (by first order symmetry of revolution) is then used to obtain the shape of the 3D pattern (and therefore of the reflector R) to obtain the required total current distribution $C_T$. Therefore, the main purpose of the 3D pattern is to modify the phase diagram of the reflector R, or in other words to introduce an offset pattern from a reference parabola, with symmetry of revolution (or rotation) from the standard shape of the said reflector R, for example parabolic.

An example of such an offset pattern is illustrated in FIG. 3.

In order to implement the above-mentioned offset pattern, the 3D pattern is preferably made in the form of projecting or recessed concentric strips BC (or "rings). It is important to note that these concentric strips BC are not necessarily continuous over 360° in all cases. They may contain areas in which they are interrupted. However, the shape of a concentric strip BC, in other words its cross-section, is constant (apart from in interrupted areas, if any).

Three partial examples of 3D patterns are shown in FIGS. 4 to 6, in cross-sectional views. More precisely, the example illustrated in FIG. 4 corresponds to a projecting symmetric 3D pattern in which the concentric strips BC are all identical (constant width d1 and constant height h) and are a constant pitch d2. As a variant, the width d1 and pitch d2 may be constant, and the height h may vary from one concentric strip BC to the next.

The example illustrated in FIG. 5 shows a projecting 3D pattern in which some concentric strips BC have different shapes and irregular spacing. For example, one concentric strip BC may have a width d1, another concentric strip BC may have a width d3 and yet another concentric strip BC may have a width d5. In this case, the spacing between adjacent concentric strips is preferably variable (in this case the spacing d2 is smaller than the spacing d4), and the height h preferably varies from one concentric strip BC to the next.

The example illustrated in FIG. 6 also shows a recessed 3D pattern in which all concentric strips BC have different shapes and irregular spacing. For example, one concentric strip BC may have a width d2, another concentric strip BC may a width d4, and yet another concentric strip BC may have a width d6. In this case, the spacing between adjacent concentric strips varies (in this case d1≠d3≠d5≠d7), and the height h preferably varies from one concentric strip BC to the next.

For example, the height h is equal to approximately 7.5 mm and the widths and spacing di are between about 80 mm and 400 mm.

As is better illustrated in FIG. 7, the concentric strips BC in the 3D pattern preferably comprise rounded leading edges BA with a radius of gyration (or curvature) between about 1 mm and about 200 mm, and even better between about 10 mm and about 40 mm.

Advantageously, this makes it possible to make the structure ST defining the 3D pattern using ultra lightweight materials frequently used in space applications, and particularly made of carbon fiber/organic matrix or other composite materials (for example CFRP—"Carbon Fiber Reinforced Plastics"), or any other equivalent material known to those skilled in the art, for example such as carbon/resin preimpregnated laminates (single directional or woven).

The material from which the 3D pattern is made may possibly be metallized in order to minimize radioelectric losses. Furthermore, a thermal check of the reflector R may conventionally be obtained using a radome placed on its front face FA and thermal insulation using the SLI ("Single Layer Insulation") technology or the MLI ("Multiple Layer Insulation") technology, for example a sheet or laminate of Kapton on its back face. As a variant, a thermal insulation may be placed on its back face only.

Note that it is important that other heavy materials, for example such as aluminum, steel or an alloy can be used in applications in which weight is not a disadvantage, for example in land applications.

FIG. 8 shows a cross-sectional view of an example of a portion of a 3D pattern in which the concentric strips BC have a cross-section of the type shown in FIG. 7, in other words with rounded leading edges BA.

In general, the 3D pattern extends over the entire front face FA of the reflector R as illustrated on the diagram in FIG. 9, but it can also extend over only a part of the front face FA of the reflector R, and in this case there are no or few concentric strips BC in the central area as illustrated on the diagram in FIG. 10. These two diagrams show a plane projection showing the positions of the different strips BC (which in this case are transformed into lines due to the projection) concentric about the center of the reflector R. The abscissa axis is graduated from 1 to 201 and materializes 200 points between the center and the edge of the reflector R. The ordinates axis materializes the height h (in mm) of concentric strips BC, for example about 7.5 mm.

Furthermore, the structure ST defining the 3D pattern may be added either onto the front face FA of the reflector R, or it may form an integral part of it. Thus, in the example illustrated in FIG. 11 (and also in the examples in FIGS. 14 to 16 which will be reviewed later), the structure ST is composed of several groups of concentric strips BC added onto the front face FA of the shell of the reflector R. In this case, each group is made using a specific mold, for example it may be added on by gluing on the front face FA of the shell of the reflector R.

In the example illustrated in FIG. 12, the structure ST forms an integral part of the shell of the reflector R. Consequently the mold used to make the shell includes the negative impression of the structure ST. Therefore, the 3D pattern is made at the same time as the shell by baking, for example at 180° C. (obviously the temperature depends on the type of resin used). This type of molds may be made using the so-called 5D machining technology. Note that the shell may-be made with a constant or variable thickness spacer.

In the example illustrated in FIG. 13, the structure ST also forms an integral part of the shell of the reflector R. Unlike the example in FIG. 12 in which only the front face comprises the 3D pattern, in this case the front face FA and the back face AR comprise the 3D pattern. This requires a mold comprising a first portion on which the 3D pattern is implanted in negative and a second portion in which the 3D pattern is implanted in positive. This embodiment of the shell of the reflector R facilitates its production, particularly series production by molding or hot stamping (between a punch and a die) or by any other technique. It is important to note that only the front face FA is functional.

As illustrated in FIGS. 14 to 16, the reflector according to the invention may be installed in the same way as any traditional reflector. Thus, in the example illustrated in a cross-sectional view in FIG. 14, the reflector R of the cellular type "thick shell" technology based on the sandwich concept is installed on an extension arm BD connected to a platform of a satellite.

In the example illustrated in a cross-sectional view in FIG. 15, the reflector R of the cellular type "stiffened thin shell" technology based on the sandwich concept is installed on a rigid structure SR of the satellite, for example using L-shaped clips. This arrangement gives good mechanical strength and good dimensional stability.

In the example illustrated in a cross sectional view in FIG. 16, the reflector with an ultra-thin shell is installed on a so-called monolithic rigid structure SR composed of a single element or an assembly of monolithic elements, for example using L-shaped clips, possibly glued. This arrangement also provides good mechanical strength and good dimensional stability.

The multifrequency reflector antenna according to the invention has many advantages compared with antennas according to prior art.

It can thus gives beams with approximately the same beam widths without any loss of efficiency.

It can also reduce secondary (or lateral) lobes regardless of the frequency considered, giving good isolation of the different frequencies and a good combined insulation ratio C/I.

It can also result in beams with comparable, or approximately identical, and reduced roll-offs.

It can also take account of the source emission diagram and/or the collector reception diagram, in order to correct any imperfections.

Finally, it can be used in any type of application and particularly in space applications, particularly because the number of antennas can be halved (for example 3 or 4 can be used whereas 6 or 8 were necessary in prior art).

The invention is not limited to the multifrequency reflector antenna embodiments mentioned above simply as examples, but it encompasses all variants that those skilled in the art could envisage within the scope of the claims given below.

Thus, the invention relates to any reflecting antenna provided with a structure defining a three-dimensional pattern with symmetry of revolution and with rounded and "soft" leading edges.

The invention claimed is:

1. Multifrequency reflecting antenna (AR) comprising a reflector (R) provided with a front face (FA) for reflecting beams of electromagnetic waves belonging to at least two different bands with at least one frequency, characterized in that the said front face (FA) includes a structure (ST) defining a three-dimensional pattern with symmetry of revolution, chosen so as to shape said beams such that they have approximately the same radiofrequency characteristics.

2. Antenna according to claim 1, characterized in that said structure (ST) approximately extends over the entire surface of said front face (FA).

3. Antenna according to claim 1, characterized in that said three-dimensional pattern is composed of projecting concentric strips (BC) comprising leading edges (BA) with a radius of curvature or gyration between about 1 mm and about 200 mm.

4. Antenna according to claim 1, characterized in that said three-dimensional pattern is composed of recessed concentric strips (BC) comprising leading edges (BA) with a radius of curvature or gyration between about 1 mm and about 200 mm.

5. Antenna according to claim 3, characterized in that said leading edges (BA) have a radius of curvature or gyration between about 10 mm and about 40 mm.

6. Antenna according to claim 3, characterized in that each concentric strip (BC) extends over a chosen width and a chosen height.

7. Antenna according to claim 6, characterized in that said chosen width is variable from one concentric strip (BC) to another concentric strip (BC).

8. Antenna according to claim 6, characterized in that said chosen width is constant from one concentric strip (BC) to another concentric strip (BC).

9. Antenna according to claim 6, characterized in that said chosen height is variable from one concentric strip (BC) to another concentric strip (BC).

10. Antenna according to claim 6, characterized in that said chosen height is constant from one concentric strip (BC) to another concentric strip (BC).

11. Antenna according to claim 6, characterized in that said concentric strips (BC) are separated from each other by a constant pitch.

12. Antenna according to claim 6, characterized in that said concentric strips (BC) are separated from each other by a variable pitch.

13. Antenna according to claim 1, characterized in that it comprises at least one source (S) for outputting at least a first beam of electromagnetic waves to be transmitted belonging to a first frequency band, and at least one collector for collecting at least a second beam belonging to a second frequency band, and in that the reflector (R) is arranged so as to transmit said first beam output from said source (S) after reflection and shaping by its front face (FA), and to receive a beam of electromagnetic waves belonging to said second frequency band to transmit it to said collector in the form of said second beam after reflection and shaping by its front face (FA).

14. Antenna according to claim 13, characterized in that said source (S) and said collector are coincident.

15. Antenna according to claim 1, characterized in that it comprises at least one source (S) of beams to be transmitted, and in that said reflector (R) is arranged to transmit said beams of electromagnetic waves belonging to at least two different frequency bands and originating from said source (S), after reflection and shaping by its front face (FA).

16. Antenna according to claim 13, characterized in that said three-dimensional pattern is chosen as a function of a transmission diagram of said source (S).

17. Antenna according to claim 1, characterized in that it comprises at least one beam collector, and in that said reflector (R) is arranged to receive said beams of electromagnetic waves belonging to at least two frequency bands, and to transmit them to said collector after reflection and shaping by its front face (FA).

18. Antenna according to claim 1, characterized in that said structure (ST) is added onto said front face (FA).

19. Antenna according to claim 1, characterized in that said structure (ST) forms a one-piece integral construction with said reflector (R).

20. The antenna according to claim 1, wherein the front face that includes the three-dimensional pattern shapes at least one of the beams so as to modify the beam width, such that the beams have approximately the same beam widths.

* * * * *